United States Patent [19]

Schwartz et al.

[11] 4,319,508

[45] Mar. 16, 1982

[54] MODULAR, EXPANDABLE DIGITAL ORGAN SYSTEM

[75] Inventors: Harold O. Schwartz, Elburn; Dennis E. Kidd, Sycamore; William R. Hoskinson, Geneva, all of Ill.

[73] Assignee: The Wurlitzer Company, DeKalb, Ill.

[21] Appl. No.: 917,310

[22] Filed: Jun. 20, 1978

[51] Int. Cl.[3] ..... G10H 1/00

[52] U.S. Cl. ..... 84/1.01; 84/1.26

[58] Field of Search ..... 84/1.01, 1.03, DIG. 22, 84/1.24, 1.19, 1.26

[56] References Cited

U.S. PATENT DOCUMENTS

| | | | |
|---|---|---|---|
| 3,534,144 | 10/1970 | Ring | 84/1.23 |
| 3,636,231 | 1/1972 | Schrecongost et al. | 84/1.19 |
| 3,696,201 | 10/1972 | Arsem et al. | 84/1.01 |
| 3,824,326 | 7/1974 | Obayashi | 84/1.01 |
| 3,828,109 | 8/1974 | Morez | 84/1.01 |
| 3,840,691 | 10/1974 | Okamoto | 84/1.03 |
| 3,981,217 | 9/1976 | Oya | 84/1.01 |
| 3,990,339 | 11/1976 | Robinson et al. | 84/1.03 |
| 4,024,786 | 5/1977 | Machanian | 84/1.01 |
| 4,041,825 | 8/1977 | Pascetta | 84/1.01 |
| 4,065,993 | 1/1978 | Hirose | 84/1.03 |
| 4,116,102 | 9/1978 | Tsunoo et al. | 84/1.01 |
| 4,185,532 | 1/1980 | Hiyoshi et al. | 84/1.26 |
| 4,202,239 | 5/1980 | Southard et al. | 84/1.26 |
| 4,216,691 | 8/1980 | Bean | 84/1.01 |

*Primary Examiner*—David Smith, Jr.
*Assistant Examiner*—Forester W. Isen
*Attorney, Agent, or Firm*—Trexler, Bushnell & Wolters, Ltd.

[57] ABSTRACT

Most of the circuitry of an electronic organ is made up of a plurality of digital large scale integrated (LSI) circuit chips. Certain of the chips can be duplicated or substituted for others of like type to provide an organ with more or less tone generators, more or less features, etc., whereby organs of various price levels can be constructed from the same basic parts. In operation, essentially all of the organ functions and features are provided by carrying out logical and arithmetic operations on digital pulse trains generated under control of a master clock.

5 Claims, 5 Drawing Figures

MODULAR, EXPANDABLE DIGITAL ORGAN SYSTEM

BACKGROUND OF THE INVENTION

Electronic organs have been known for many years. Early electronic organs used various electro-mechanical devices for generating electrical oscillations corresponding to musical tones. Various types of electronic oscillators have been used to provide such oscillations. Some organs have used an independent oscillator for each tone. This is an expensive construction, and for cost saving reasons, it has been common practice to provide twelve oscillators to provide the semitones of the top octave, and to use divide-by-two circuits to provide the tones in lower octaves. More recently, it has become well-known to use a single radio frequency oscillator with divider circuits of different divider ratios to produce the top octave of tones. This system is sometimes known as a top octave synthesizer (TOS). Strings of divide-by-two circuits have been used to provide the notes in lower octaves of the organ. However, organs using these techniques have had only limited capability for expansion and were modular through historical evolution of sub-system elements rather than overall system design.

With the advent of reliable large scale integrated circuits (LSI) chips efforts have been made to construct electronic organs utilizing digital circuits. It is relatively easy to construct LSI chips that utilize digital circuits whereas it is relatively difficult to utilize analog circuits in such LSI chips. A need therefore remains for an organ system which is essentially completely digital in nature to take advantage of the full potential of integrated circuit technology.

OBJECTS AND BRIEF DISCLOSURE OF THE PRESENT INVENTION

It is an object of this invention to provide an electronic organ in which essentially all of the organ functions are obtained by carrying out logical and arithmetic operation on digital square and rectangular wave forms.

It is an object of the present invention to provide an electronic organ in which a very high percentage of the functional parts is provided on digital integrated circuit chips.

A further object of the present invention is to provide a modular electronic organ having a plurality of LSI chips therein, which chips can be duplicated or substituted to provide a very basic and inexpensive electronic organ through a very complex and expensive electronic organ.

In carrying out the aforesaid objects and other objects and advantages in accordance with the present invention, an electronic organ or other electronic keyboard musical instrument is constructed of a plurality of large scale integrated circuit chips with different families of chips wherein certain thereof can be used in conjunction with one another, or substituted for one another, thereby providing a large degree of flexibility of construction of an electronic organ in a modular system. Letter designations are used hereinafter for various chips for best reference and understanding thereof. Thus, a rhythm chip is designated as an A-1 chip that has rhythm functions thereon. A chording chip is designated as an A-2 chip, while different types of B chips are used as keyer chips depending on the nature of the keying and voice functions desired. The chips interact with one another, and are not simply compartmentalized.

The A-1 chip provides both rhythm and control of multiplexing. Among the rhythm functions are frequencies for rhythm voices and also a noise source. Multiple A-1 chips may be used to provide more complex rhythm patterns and to provide more rhythm voices.

The A-2 chip provides both chord and bass frequency generation. The chords may be played in an automatic single finger mode on a twelve note section of the keyboard or manually on an eighteen note section of the keyboard.

The chord notes may be played in a latched or an unlatched mode. Each audio output of the A-2 chip is under an independent envelope that has control of all attack and decay characteristics. The A-2 chip receives trigger information from the A-1 chip for the chord and bass audio outputs so that these may be timed with the rhythm of the A-1 chip. The A-2 chip works in conjunction also with the B chips so that all may share the same keyboard without interfering with one another.

The B chips, which are keyer chips, are primarily of two major types. In the first type, the frequency generators on the chip may be assigned to any place on the keyboard. As is common in organ constructions, a number of keys on the keyboard may be 37, 44 or 61. The second class of B chip has generators thereon which can only be assigned to one octave span of a keyboard. The number of generators is limited to a predetermined number per keyboard or manual, and are thus non-redundant. Various frequency outputs are independent of one another under two types of envelope, namely sustain or percussion. Each B chip provides various groups of audio outputs, each with its own characteristic spectral content or waveform duty cycle at various footages depending on the chip. Multiple use of B chips in any combination provides on a single manual multiple pitches, envelopes and envelope characteristics per key. All chips in the system are operated from a single data clock so that operation of any chip at any time is synchronized with the operation of other chips.

Partitioning of the circuit functions among a set of chips in accordance with this invention provides increased flexibility in the types of organs that can be assembled from the same basic chip types. As will be seen in further detail, essentially all of the organ functions are achieved in this invention by carrying out various logical and arithmetic operation on digital pulse trains. In this manner, for example, different tones are produced, different voices are provided, percussion sounds are produced, chords are recognized and synthesized, undesirable locking of oscillators is avoided, controllable attack and decay is provided, and the like. For these reasons, an organ in accordance with this invention is a true digital organ whereas typical prior art organs utilizing some digital circuits are essentially analog organs with digital appendages.

THE DRAWINGS

FIG. 1 comprises a schematic wiring diagram of the overall system of an entire electronic organ constructed in accordance with the principles of the present invention;

FIG. 2 comprises a block diagram with details of wiring for switching back and forth between two A-1 chips;

DETAILED DISCLOSURE

Figure 1:
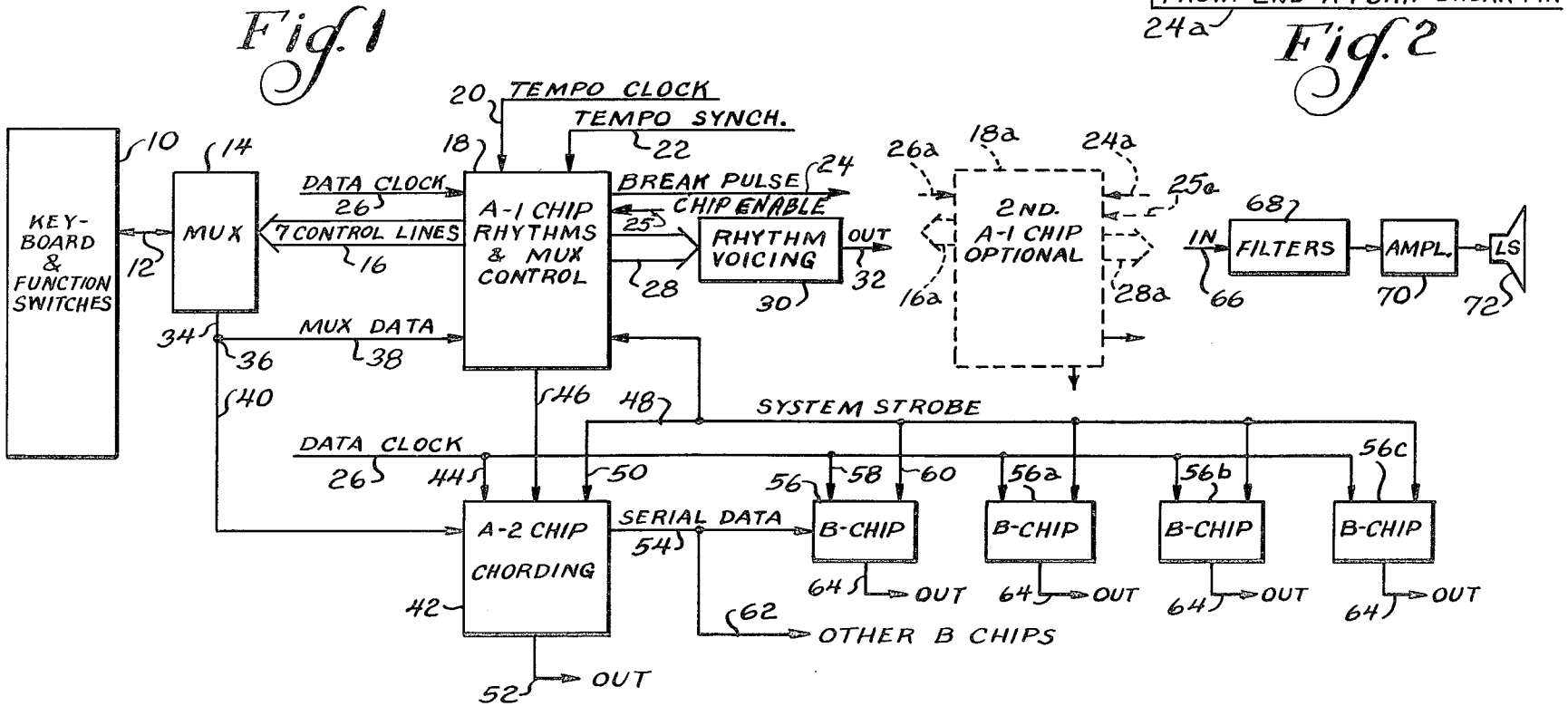

Attention now should be directed to FIG. 1 wherein the keyboard of an electronic organ or other electronic musical instrument is identified generally at 10. The keyboard includes both key switches and function switches, the latter generally being stop tablet controlled for various organ voices and features of the organ. The keyboard is interconnected at 12 with a multiplexing unit 14 which is controlled through seven control lines 16 by an A-1 chip 18 having rhythms and multiplex control. A full disclosure of the A-1 chip may be found in the copending application of Harold O. Schwartz and Dennis E. Kidd filed June 20, 1978 under Ser. No. 917,311. The A-1 chip 18 which is controlled by a tempo clock 20 is disclosed functionally. A tempo sync line 22 may interconnect the A-1 chip 18 with a second, optional A-1 chip 18*a*. A break pulse line 24 also interconnects the A-1 chip 18 with the optional second A-1 chip 18*a*. In order to avoid duplication of explanation, connections to and from the second optional A-1 chip are identified with the same numerals as those used for the first chip 18, but with the addition of the suffix a.

It has been mentioned heretofore that the A-1 chip is under the control of the tempo clock input at 20, and this is for the rhythm timing. A data clock is also connected to the A-1 chip 18 at 26, to insure proper synchronization of data to all the chips in the system. In addition to the connections to the A-1 chip 18 previously discussed, there is a plural output 28 to the rhythm voicing unit 30, which has an output at 32. No matter how many A-1 chips may be used in the system, the outputs of all of them are connected to the same rhythm voicing unit. The multiplexing control lines 16*a* from an optional A-1 chip 18*a* may be used to control a different multiplexing unit for a different keyboard (such as is typically provided on a more complex organ) than the control lines 16 from the first mentioned A-1 chip 18.

The multiplexed serial data produced by the multiplexing unit 14 is provided on an output line 34 to a junction point 36. The serial data from the junction point 36 is transmitted by way of a connector 38 back to the A-1 chip 18 (and any second or more optional A-1 chips as 18*a*). A second connection 40 from the junction 36 carries the serial multiplex data to an A-2 chip 42. Again, functions of this chip are set forth in the present disclosure, while circuit details of this chip are to be found in the copending applications of William R. Hoskinson and Harold O. Schwartz, filed June 20, 1978 under Ser. No. 917,312 and the copending application of William R. Hoskinson and William V. Machanian filed June 20, 1978 under Ser. No. 917,305. The data clock line 26 is connected at 44 to the A-2 chip to insure proper synchronous operation with all other chips in the system. The A-1 chip 18 has an output leading at 46 to an input of the A-2 chip 42. In addition, there is a system strobe line 48 connected through all of the chips including the A-2 chip 42 at 50. There is a redundant data counter in each chip disclosed herein. If any one counter goes to zero it pulls down the system strobe and all counters are reset to zero. This is a wire OR function which is normally held high.

The A-2 chip 42 has two outputs. One output at 52 carries the chording information. Another output 54 carries the multiplexed serial data, and may be considered as an extension of line 40 except that some data present on line 40 may not appear on line 54. The serial data line 54 leads to a first keyer or B-chip 56 which has a data clock input at 58 and a system strobe input at 60. The serial data line 54 has a junction and continues at 62 for connection to other B chips. Some details of connection are shown in subsequent figures, and for the present it is only noted that there are additional B chips 56*a*, 56*b* and 56*c*, all connected to the system strobe, data clock and serial data the same as the first B chip 56. Some details of the B chip will be set forth hereinafter, and others are to be found in copending applications hereinafter to be identified.

Each B chip has an output 64, and these outputs along with the outputs 52 of the A-2 chip 42 and the output 32 of the rhythm voicing unit 30 are connected to an input 66 to filters 68 and then on to an amplifier 70 feeding a loudspeaker 72 or other suitable electro-acoustic transducer.

Figure 2:
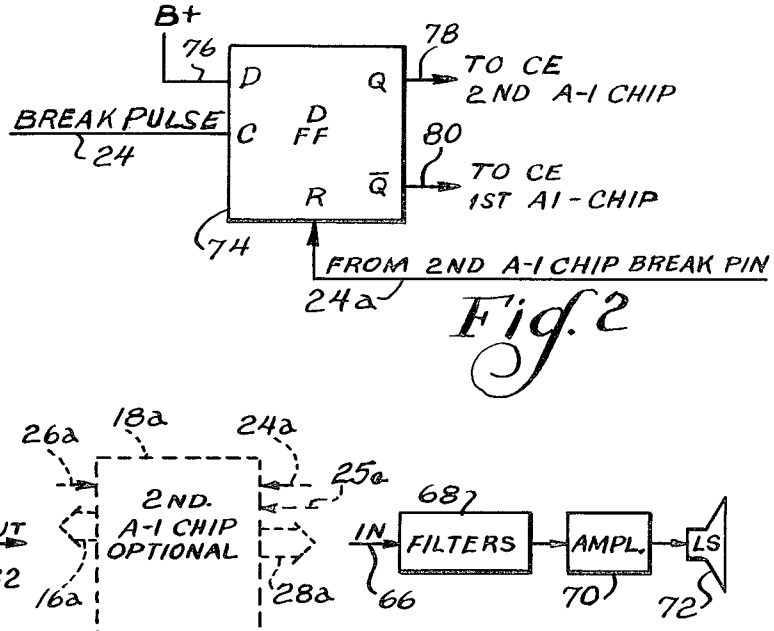

The manner in which one or another of the A-1 chips is operative will be understood with regard to the D flip-flop 74 in FIG. 2. The flip-flop has its D input tied to a positive voltage source B+ on a line 76. The break line 24 carrying the break pulse is applied to the C input of the flip-flop 74. The output of the break pulse of the second or optional A-1 chip is carried on the break line 24A to the reset input of the flip-flop 74. The Q output on a line 78 leads to a chip enable input 25*a* of the second A-1 chip. Similarly, the $\overline{Q}$ is connected on a line 80 to the chip enable pin or connection of the first A-1 chip. When the flip-flop of FIG. 2 is used with two A-1 chips including the optional one in FIG. 1, some point or points in a rhythm pattern will produce a break pulse on the appropriate break line to cause the flip-flop 74 to change state to enable the other A-1 chip. Thus, a coordinated section of rhythms may alternate, or sequence in the case where flip-flop 74 is only one stage of a multiple stage shift register controlling several A-1 chips.

It is contemplated that instead of the flip-flop of FIG. 2, an X bit counter could be used to alternate the A-1 chips on other than a strict flip-flop basis. This would also make it possible to utilize more than two A-1 chips. By use of two or more A-1 chips connected in parallel, additional rhythm patterns can be established. Series connection of A-1 chips allows a larger word count for a given rhythm. The rhythm program could be operated on 24 or 48 counts with the first half in one chip and the other half in the second chip. Two 48 count patterns could be provided to give a total of 96, which would allow the use of three 32 count rhythm patterns which is sometimes desirable.

Figure 3:
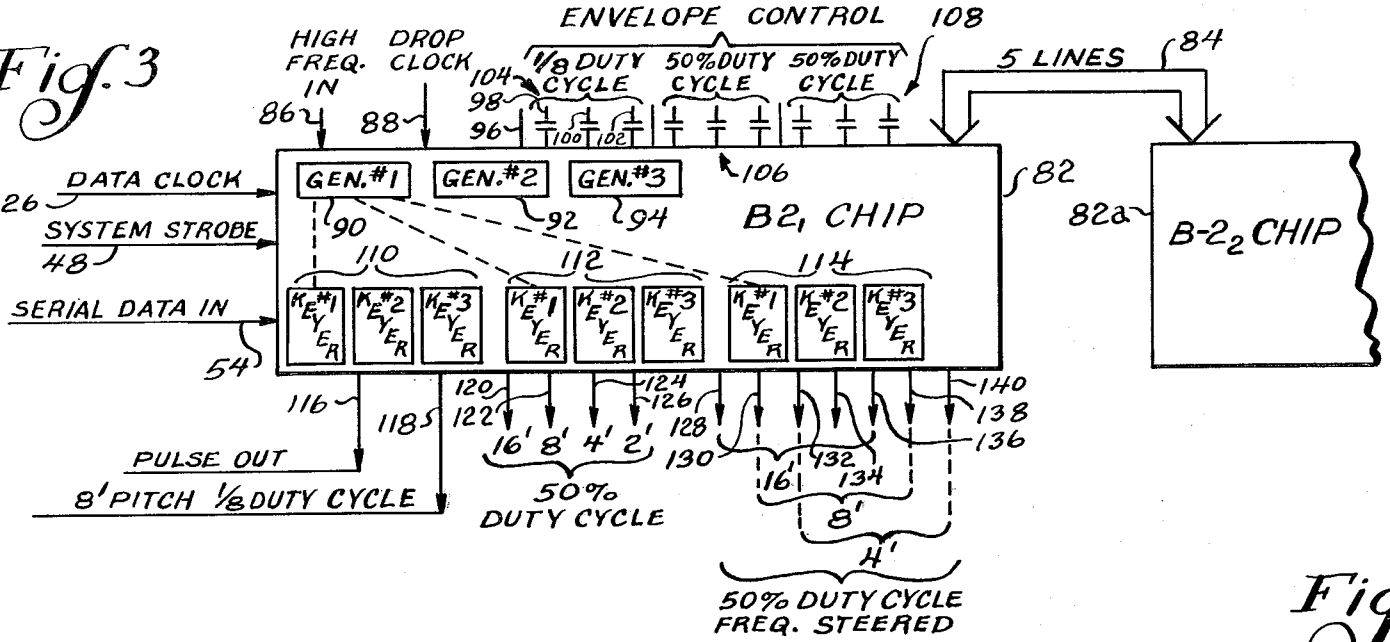
FIG. 3 is a schematic diagram showing certain functions of a B-2 chip and the interconnection of two B-2 chips.

Before turning to a further discussion of the relationship of the B chips to one another, attention should be devoted to FIG. 3 wherein certain aspects of the B chip are shown. Specific details of generator assignment hereinafter to be discussed. Other details of the B-2 chip now to be discussed are to be found in the copending application of Harold O. Schwartz and Dennis E. Kidd filed June 20, 1978 under Ser. No. 917,313.

For a functional description of the B-2 chip, attention should be directed to FIG. 3 wherein there is shown a B-2 chip 82, identified on its face as B-$2_1$ chip. A second B-2 chip 82*a* is identified on its face as B-$2_2$ chip. These two chips are connected for parallel operation by five lines 84 interconnecting proper terminals or pins of the two chips. The data clock line 26 has an input into the chip 82, as do the system strobe line 48, and the serial data line 54 previously noted in connection with FIG. 1. Another input to the B-2 chip comprises a high frequency clock supplying high frequency oscillations on the order of four MHz at 86. This clock could be at a lower frequency as low as two or even one MHz. The B-2 chip has three generators 90, 92, and 94. Each of these generators is capable of generating any of the frequencies of 61 notes on the organ keyboard. Accommodation can be made readily to lesser or greater numbers of keys. Each generator comprises at least in part a divider of the high frequency input signal at 86, each dividing with a different ratio according to the given output tone. The drop clock signal on the line 88 causes a pulse to be dropped every so often so that none of the three generators is exactly the mathematically correct frequency, differing only by enough to avoid locking of the generators to one another in mathematically exact frequencies, whereby to present a better musical effect. The specifics of this function are to be found in the copending application of Anthony C. Ippolito and William R. Hoskinson filed June 20, 1978, under Ser. No. 917,296 now U.S. Pat. No. 4,196,651. A single B-2 chip can be used to produce three melody notes, which for less expensive instruments is sufficient. With the addition of a second B-2 chip as shown in FIG. 3 a total of six melody notes can be provided which is sufficient for most purposes. In theory twenty chips could be connected together to produce sixty generators which would cover all but one note of a sixty-one note keyboard to be played at one time. An additional B-2 chip could allow the sixty-first note to be played, but going to such extreme is quite unnecessary since under practical circumstances it is rare that one would want more than six melody notes to be played at one time. However, the capability is there, and with one or two chips redundancy of generators is greatly diminished or entirely eliminated, depending on one's viewpoint.

Envelope control of the frequencies being generated in the B-2 chip 82 is effected by three like sets of input controls 96 and capacitors 98, 100, and 102. This envelope control is detailed in the copending application of William R. Hoskinson filed June 20, 1978 under Ser. No. 917,308. The first such set is identified by numeral 104 and controls a one eighth duty cycle output wave. The second such control at set 106 is identified by numeral 106 and controls a 50% duty cycle output wave. The third set 108 controls a 50% duty cycle frequency steered output. More will be said about the frequency steering shortly hereinafter.

Within the bottom of the rectangle comprising the B-2 chip 82 there are shown three sets 110, 112, and 114 of keyers, each comprising keyer 1, keyer 2 and keyer 3. The frequency of each generator is assigned in accordance with the aforesaid Schwartz and Kidd application (attorneys docket number 688I). Each generator is keyed out of the chip by respectively numbered keyers. Thus, Generator #1 is keyed by means of the 3 keyers #1, etc.

A pulse output is provided at 116, and a pulse is outputed at this connection each time a new key is played. This pulse is of approximately 12 msec. duration. There is also an output 118 of eight foot pitch at a one eighth duty cycle. Next to that are shown outputs 120, 122, 124 and 126, all at 50% duty cycle, for, respectively, 16', 8', 4' and 2' organ voices. For example, if a 16' tone is to be played on the organ in accordance with setting of the function switches, no matter what key may be depressed on the keyboard, the 16' tone will be outputed at 120.

Next to that are seven output connections 128, 130, 132, 134, 136 and 140. The output of these respective connections is a 50% duty cycle which is frequency steered. In order to comprehend the frequency steering, attention should be directed to the fact that the first five pins, namely pins 128 through 136, will output a 16' voice, with one octave per pin or connection. Thus, the lowest octave of the organ will appear at output connection 128 in a 16' voice. This output connection serves only the lowest octave and no other. Similarly, on the 16' voice output connection 130 serves only the second octave, and no other. This continues through the pins up through 140. The advantage to this is that more precise filtering can be obtained for the desired harmonic content of the tone to be played. That is to say that there can be one filter per octave, rather than one filter for an entire 16' voice.

Similar explanation applies relative to the 8' voice which appears one octave at a time on pins 130 through 138. In like manner the 4' tones are produced on pins or connections 132 through 140.

Figure 4:
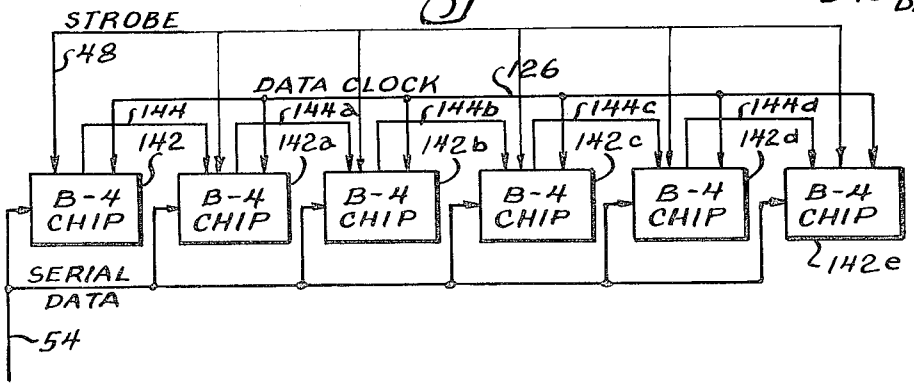
FIG. 4 is a block diagram showing the connection of a plurality of B-4 chips.

Connection of various B-4 chips is shown in FIG. 4. Details of the B-4 chip are disclosed in the copending patent application of Harold O. Schwartz and William R. Hoskinson filed June 20, 1978 under Ser. No. 917,314. Thus, there are shown six B-4 chips 142, 142*a*, 142*b*, 142*c*, 142*d*, and 142*e*. Each of the B-4 chips covers one octave and one octave only. The number of six octaves here is sufficient to cover a 61 note keyboard. The first of the B-4 chips 142 is only accountable for one note, since the remaining five B-4 chips are sufficient to cover the five octaves for sixty keys. For smaller organs lesser numbers of B chips would be used. Each B-4 chip receives an input from the data clock 126, an input from system strobe 48, and also receives an input from the serial data line 54. The system strobe line 48 is also connected to the first B-4 chip at an input called chip position in which then sends a strobe signal over a line 144 to the second B-4 chip. This is continued serially with the same number 144 being used with the addition of suffixes a through d corresponding to the like B-4 chips with similar suffixes, to identify the octave placement of each chip.

Figure 5:
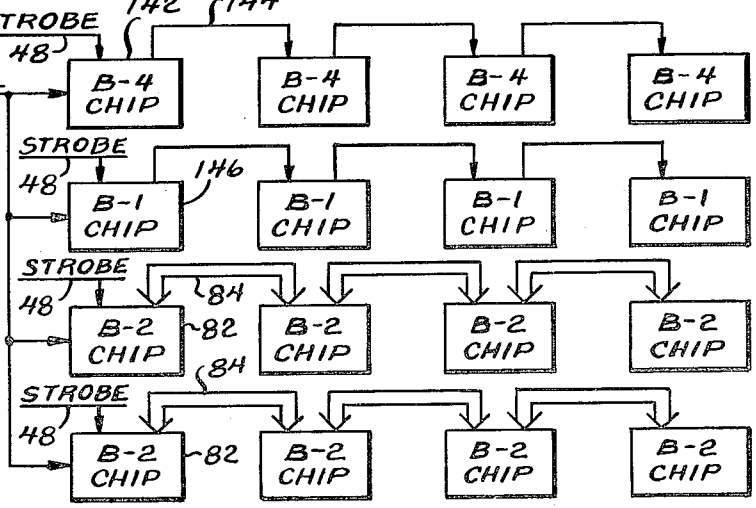
FIG. 5 is a block diagram showing the interconnection of a large number of B chips of three different varieties.

Consideration has just been given as to the provision of six B-4 chips for an organ having a sixty-one note keyboard. Additional chips of the B family can be interconnected as is shown in FIG. 5. In this figure there are shown four B-4 chips 142, this being sufficient for a spinet organ having a keyboard of thirty-seven or forty-four notes. Some simplification of the drawing has been made in FIG. 5 to prevent crowding, but the input from the system strobe at 48 to the first B-4 chip is carried through successive B-4 chips through the interconnections 144. Serial data is entered from the serial data line 54 as before. In addition to the B-4 chips in FIG. 5 there is a like number of B-1 chips 146 which are controlled by the system strobe 48, and also have an input from the serial data line 54.

There are also two rows of B-2 chips 82, each row having four B-2 chips therein, and both supplied with serial data from the line 54, and strobed from the system strobe at 48. The five lines of interconnection 84 are as previously described under FIG. 3 with regard to the B-2 chips.

Specifics of the B-1 chip may be found in the corresponding copending application of Harold O. Schwartz and Dennis E. Kidd filed Nov. 11, 1978 under Ser. No. 962,981, while details as to the B-4 chip can be ascertained from the copending application of Harold O. Schwartz and William R. Hoskinson filed on June 20, 1978, under Ser. No. 917,314.

From the foregoing it will be seen that a very basic and simple organ could be made with just one B chip and an external counter for multiplexing. Better musical capabilities and little use of large scale integrated circuit chips is attained by providing one A-1 chip and four B chips of one sort or another. Improvement can be made as to features by adding an A-2 chip, and by adding other B chips in accordance with FIG. 5. The conventional 37 and 44 note spinet keyboards can be handled as well as can a full organ keyboard of sixty-one notes, simply by adding on additional B chips. It thus will be seen that a modular, expandable organ has been disclosed in which anything from a small and inexpensive organ up through a large and very expensive and comprehensive organ can be constructed by the addition of more modules or chips without the necessity of effecting any changes in the basic electronic construction of the organ.

The specific examples as herein shown and described are for illustrative purposes. Various changes will no doubt occur to those skilled in the art and will be understood as forming a part of the present invention insofar as they fall within the spirit and scope of the appended claims.

The invention is claimed as follows:

1. A modular expandable organ system comprising a keyboard having a plurality of keys and a plurality of key switches, amplifier means and electro-acoustic transducer means connected to said amplifier means, and means interconnecting said key switches and said amplifier means comprising at least one digital large scale integrated circuit chip having a plurality of outputs and further comprising means for carrying out logical arithmetic operations on digital pulse trains for generating electrical oscillations corresponding to musical tones and to control such oscillations for playing musical compositions and means for keying said electronic oscillations to said outputs, said oscillations generating means comprising a plurality of generators each capable of producing electronic oscillations corresponding to any of said keys, the outputs of said chip comprising a multiple of the number of generators, the keying means comprising a like multiple of keyers, a plurality of envelope control means, each control means being connected to a respective output means whereby a given oscillation may have a plurality of different envelopes, means interconnecting said output connections and said amplifier means, multiplexing means external of said chip interconnecting said key switches and said chip, and a single serial data line extending from said multiplexing means to said chip for controlling said generators and said keyers such that each of said generators can be assigned to operate with any key.

2. A digital electronic musical instrument system, comprising, in combination:

(A) means providing a clock frequency and a plurality of first circuit means connected to said clock frequency means for producing a plurality of rectangular waves, each of different selected fundamental frequency and selected duty cycle;

(B) a plurality of second circuit means for combining selected ones of said plurality of rectangular waves in their rectangular wave form to produce an output waveform having a selected fundamental frequency and selected harmonic content;

(C) a plurality of digital attack circuit means and a plurality of digital decay circuit means connected to modify said output waveform produced by said second circuit means; there being a sufficient number of said second circuit means to provide separate groups of said second circuit means for said electronic musical instrument and a sufficient number of said attack and decay circuits to provide a separate attack and a separate decay circuit for each group of said second circuit means;

(D) means for generating pulse dropping oscillations at a fixed frequency which is low in relation to the clock frequency; and (E) means for eliminating pulses from said clock frequency in accordance with the frequency of said pulse dropping oscillation generating means.

(F) a plurality of switches and manually operable means for operating said switches;

(G) multiplexing means operable in connection with said switches to provide serial data for selective assignable generation of tones by said first and second circuit means; and (H) means for generating control signals for establishing a rhythm pattern in the output waveforms for said plurality of second circuit means.

3. The system of claim 2 in which said means for generating control signals includes a memory means having rhythm pattern information stored therein in rows and columns, counter means for sequentially accessing said rhythm pattern storage information in each row uniquely identifying a particular bass root, a chord partial note related to said bass root, or no bass to be played during count of said counter corresponding to that row containing the information.

4. The electronic musical instrument of claim 3 additionally comprising:

(I) shiftable memory storage means connected to said plurality of switches and having a plurality of bit positions, each bit position corresponding to a note which may be played by said means for operating said switches, a first state of a bit position indicating that a note corresponding thereto is not being played, and a second state indicating that a note corresponding thereto is being played, (J) means connected to said shiftable memory means for determining whether a selected bit position corresponding to a root note and at least an additional bit position corresponding to a partial of said root note are in said second state, and (K) means connected to said shiftable memory means for shifting the information in said shiftable memory means.

5. The system of claim 4 additionally comprising:

(L) means interconnecting said multiplexing means and said first and second circuit means for causing said second circuit means to continue to produce oscillations corresponding to active switches even if said switches become inactive, said interconnecting means including means for counting the number of active switches in each scan of the switches and means for resetting said second circuit means when the number of active switches is different than on a previous scan.

* * * * *